US005454363A

United States Patent [19]

Sata

[11] Patent Number: 5,454,363

[45] Date of Patent: Oct. 3, 1995

[54] HIGH-TEMPERATURE EXOTHERMIC DEVICE

[75] Inventor: Nobuhiro Sata, Sendai, Japan

[73] Assignee: Japan as represented by Director General of Agency of Industrial Science and Technology, Japan

[21] Appl. No.: 321,859

[22] Filed: Oct. 14, 1994

[51] Int. Cl.[6] ..... F24J 1/00

[52] U.S. Cl. ..... 126/263.01; 44/250; 149/15

[58] Field of Search ..... 126/263 R, 263 A, 126/262; 44/250; 149/15, 87; 102/202.5, 204, 289

[56] References Cited

U.S. PATENT DOCUMENTS

| | | | |
|---|---|---|---|
| 2,953,443 | 9/1960 | Lloyd | 149/37 |
| 3,160,537 | 12/1964 | Trafton | 149/37 |
| 3,811,422 | 5/1974 | Olson | 126/263 R |
| 4,013,061 | 3/1977 | Trumble et al. | 126/263 R |
| 5,018,505 | 5/1991 | Suzuki et al. | 126/262 |

*Primary Examiner*—James C. Yeung
*Attorney, Agent, or Firm*—Wenderoth, Lind & Ponack

[57] ABSTRACT

Proposed is a compact high-temperature exothermic device by utilizing the heat of reaction of a reactive metal powder, e.g., titanium and zirconium, and a powder of boron and/or carbon mixed together in about the stoichiometric proportion forming a calorific mixture. The exothermic device is constructed by filling a hermetically sealable container of a metallic or ceramic material with the calorific mixture which is contacted at one end portion with an ignition means to cause ignition of the calorific mixture by supplying, for example, electric energy. The ignition means can be hermetically sealed in the container and the electric circuit of the ignition means comprises a switching means with a coil spring consolidated with a solder alloy in a constricted state in such a fashion that, when the solder alloy is melted down by heating from outside, the coil spring is released to close the electric circuit by bringing a contact point held thereon into contact with a couterpart contact point.

12 Claims, 1 Drawing Sheet

HIGH-TEMPERATURE EXOTHERMIC DEVICE

BACKGROUND OF THE INVENTION

The present invention relates to a high-temperature exothermic device or, more particularly, to a compact high-temperature exothermic device to serve as a heat source for a high temperature of 500° to 3000° C. by utilizing heat of chemical reactions without supply of any energy from outside in the form of fuels, electric power, light and the like so as to be suitable for mounting in a very limited space such as spacecrafts, equipment for high-pressure experiments, equipment for experiments under vacuum and the like.

As is well known, conventional heating apparatuses include combustion furnaces by utilizing fuels such as heavy oil, firewood, fuel gases and the like, electric furnaces, infrared image furnaces, high-frequency induction furnaces, solar furnaces by utilizing sunlight and so on. These heating apparatuses naturally depend on the external supply of energy in the form of a large amount of fuels, large-capacity batteries and the like and require devices for the conversion of the source energy into heat or for the light-convergence for focusing the sunlight. Accordingly, these conventional heating apparatuses as a system cannot be compact enough and are not suitable for use in a very limited space such as spacecrafts, equipment for high-pressure experiments, equipment for experiments under vacuum and the like.

SUMMARY OF THE INVENTION

The present invention accordingly has an object to provide a novel compact high-temperature exothermic device suitable for use in spacecrafts, equipment for high-pressure experiments, equipment for experiments under vacuum and the like in which the space available for the heat source is very limited.

Thus, the high-temperature exothermic device of the invention is a hermetically sealed integral device which comprises:

(a) a hermetically sealable container made from a metallic or ceramic material;

(b) a mixture consisting of a powder of a metal selected from the group consisting of titanium, zirconium, niobium and hafnium and a powder of boron or carbon as a calorific source to fill at least a part of the container; and (c) an ignition means in contact with the calorific source to ignite the calorific source.

DETAILED DESCRIPTION OF THE PREFERRED EMBODIMENTS

Figure 1:
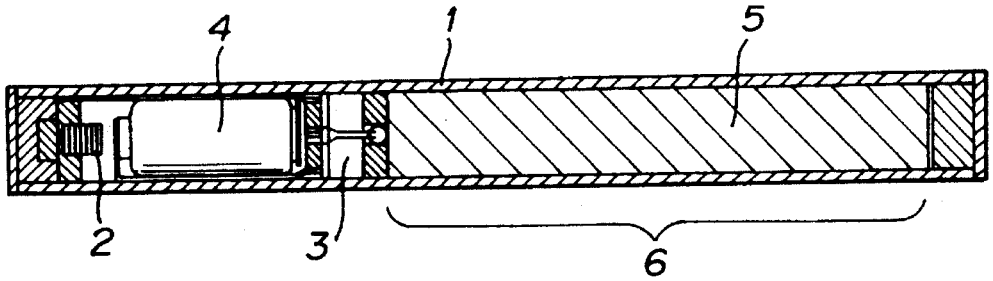
FIG. 1 is an axial cross sectional view of the exothermic device of the invention.

As is described above, the high-temperature exothermic device of the invention utilizes the heat of reaction between a powder of a specific metal and a powder of boron or carbon forming a calorific mixture contained in a hermetically sealed container of a metallic or ceramic material. This unique exothermic device has been developed as a result of the extensive investigations undertaken by the inventor with an object to obtain a compact exothermic device capable of generating a high-temperature without any accessory devices and without supply of energy from outside arriving at an idea that the object can be achieved by utilizing the heat of reaction of a certain chemical reaction proceeding in a specific calorific mixture of reactive powders generating a large quantity of heat by itself in a hermetically sealed container.

The metallic or ceramic material to form the container of the inventive exothermic device is selected naturally depending on the highest temperature desirably to be attained by the exothermic device. When the desired highest temperature is in the range from 500° to 1000° C., for example, various metals and alloys such as copper, iron, nickel, stainless steels and the like can be used as the material of the container. When the desired highest temperature is in the range from 1000° to 3000° C., metals of high melting point such as tungsten, tantalum, molybdenum and the like and ceramics such as silicon carbide, silicon nitride, graphite and the like can be used as the material resistant to the temperature. The possible highest temperature which can be attained depends on the composition of the calorific mixture and the metallic or ceramic material of the container must be selected to have a melting point not lower than the possible highest temperature attainable with the respective mixture as the calorific source.

The calorific mixture contained and hermetically sealed in a container made from the metallic or ceramic material described above consists in a powder of a reactive metal such as titanium, zirconium, niobium, hafnium and the like and a powder of boron, carbon or a combination of boron and carbon. These reactive powders have an average particle diameter in the range from 0.1 to 100 μm or, preferably, from 0.5 to 50 μm. The above named reactive metals can be used either singly or as a combination of two kinds or more according to need.

The maximum temperature which can be attained depends on the chemical composition of the calorific mixture and the mixing ratio of the reactive metal powder and the powder of boron and/or carbon. When the calorific mixture consists of a reactive metal powder and boron powder, for example, the mixing ratio of metal to boron can be selected within the range of 1:1 to 1:3 by moles but the highest temperature can be obtained with a mixing ratio of about 1:2 by moles. When the calorific mixture consists of a reactive metal powder and carbon powder, for example, the mixing ratio of metal to carbon can be selected within the range of 2:1 to 1:2 by moles or, preferably, from 1:2 to 1:1 by moles but the highest temperature can be obtained with a mixing ratio of about 1:1 by moles.

The reaction equations for specific combinations of the reactive metal and boron or carbon and the adiabatic combustion temperatures obtained by the combustion of the stoichiometric mixture are as shown below.

| Reaction equation | Adiabatic combustion temperature, °C. |
|---|---|
| $Nb + 2B \rightarrow NbB_2$ | 2441 |
| $Ti + 2B \rightarrow TiB_2$ | 2920 |
| $Zr + 2B \rightarrow ZrB_2$ | 3050 |
| $Hf + 2B \rightarrow HfB_2$ | 3250 |
| $Nb + C \rightarrow NbC$ | 2523 |
| $Ti + C \rightarrow TiC$ | 3017 |
| $Zr + C \rightarrow ZrC$ | 3357 |

-continued

| Reaction equation | Adiabatic combustion temperature, °C. |
|---|---|
| Hf + C → HfC | 3627 |

When the desired highest temperature to be attained with the inventive exothermic device is lower than the above listed adiabatic combustion temperature, the calorific mixture is prepared from a mixture of the reactive metal powder and powder of boron and/or carbon in a mixing proportion deviated from the stoichiometric proportion given by the respective reaction equations. Alternatively, the calorific mixture can be admixed with a powdery temperature modulator which does not pertain to the combustion reaction of the reactive metal and boron and/or carbon. Various metallic and ceramic materials in the form of a powder can be used as the temperature modulator depending on the intended highest temperature, of which good coincidence can be obtained between the temperature estimated by calculation taking into account the heat capacity of the container and the actual experimental temperature, and includes copper, nickel, aluminum, iron and other metals and aluminum oxide, zirconium oxide, niobium oxide, silicon dioxide, magnesium oxide, silicon carbide, titanium carbide, niobium carbide, titanium boride, zirconium boride, niobium boride and other ceramics. These powders as the temperature modulator can be used either singly or as a combination of two kinds or more according to need. When the calorific mixture is admixed with such a temperature modulator, the highest temperature attained by the combustion of the calorific mixture can be controlled to be lower than the adiabatic combustion temperature of the calorific mixture as such. When the temperature modulator is melted by the heat of combustion of the calorific mixture, the melt thereof serves to stabilize the high temperature condition with the heat capacity or latent heat of solidification of the melt so that the duration of the highest temperature can be extended so much. The amount of the temperature modulator added to the calorific mixture naturally depends on the desired extent of temperature control but it is usually in the range from 5 to 80% by weight based on the total amount of the mixture consisting of powders of the reactive metal and boron and/or carbon and the temperature modulator.

In the following, the high-temperature exothermic device of the invention is illustrated in more detail by making reference to the accompanying drawing illustrating a preferable embodiment of the invention.

FIG. 1 illustrates an example of the structure of the exothermic device of the invention by an axial cross sectional view, of which the cylindrical container 1 made from a metallic material contains a compact of a calorific mixture 5 consisting of a powder of metallic titanium and a powder of boron and the container 1 is provided at one end thereof with an ignition means consisting of a switching means 2, ignitor 3 and battery 4.

Though not limitative to that described below, the switching means 2 has such a structure that a coiled spring is held in a constricted state by means of a solidified low melting-point metal or alloy such as a solder alloy to keep the contact point apart from the counterpart contact point opening the electric circuit of the ignitor 3. When the ambient temperature is increased to reach and exceed the melting point of the solder alloy, the solder alloy is melted down to release the constricted coil spring to cause contacting of the contact points so that the electric circuit involving the battery 4 and the ignitor 3 is closed to ignite the calorific mixture 5 in contact with the ignitor 3 of the ignition means at one end. Once the calorific mixture 5 is ignited at one end, the combustion zone is rapidly propagated toward the other end at a velocity of 10 to 20 mm/second. In this way, the whole walls of the metallic container are heated by the heat evolved in the calorific mixture up to a temperature of 500° to 3000° C. depending on various factors including the quantity of heat evolved, heat capacities of the calorific mixture per se and container and so on. In the above described embodiment, the ignition means including the battery is entirely sealed in the container and the switching means is released to close the electric circuit of the ignition means relying on melting down of the solder alloy but it is of course possible to utilize external electric or magnetic field or high energy radiation as a releaser of the switching means.

The dimensions of the hermetically sealable container of the inventive exothermic device are not limitative and the container in a cylindrical form can be as compact as desired, for example, with an outer diameter of 10 mm and a length of 90 mm.

In the following, examples are given to illustrate the high-temperature exothermic device of the invention in more detail.

EXAMPLE 1

A cylindrical container of stainless steel having an outer diameter of 10 mm, inner diameter of 8 mm and length of 90 mm was filled with 4.18 g of a powdery calorific mixture described below to form a powder compact of about 50 mm length and an ignitor assembly consisting of a temperature sensor working at 100° C., silver oxide battery and fuse head as the ignitor with a platinum filament was put into the container in such a fashion that the fuse head was in contact with the powder compact of the calorific mixture. The stainless steel container was sealed at both ends by welding in vacuum using an electron beam welder carefully not to cause premature ignition of the calorific mixture by the heat of welding. The temperature sensor had a structure in which a small coil spring was held in a constricted state by consolidation with a solder alloy having a melting point of about 100° C. so that, when the solder alloy was melted down by increasing the ambient temperature to exceed 100° C., the coil spring was released from the constricted state bringing a contact point into contact with the counterpart contact point to close the electric circuit whereby the fuse head could be ignited momentarily by the electric current from the silver oxide battery connected thereto by lead wires.

The calorific mixture was prepared by uniformly blending a titanium powder having fineness to pass through a 350 mesh screen and a boron powder having an average particle diameter of about 0.5 μm in a molar ratio of 1:2 and contained 27% by weight of an aluminum oxide powder. The above mentioned mixing ratio of the titanium powder and boron powder was selected so that the maximum temperature attainable by the combustion of the calorific mixture was 2507° C. by calculation in order that the boiling point of metallic aluminum, i.e. 2525° C., was never exceeded even when reduction of the aluminum oxide powder took place to form metallic aluminum. The maximum temperature on the walls of the container estimated by calculation was 936° C. when the heat capacity of the stainless steel container was taken into account.

The thus constructed exothermic device was subjected to an ignition test by externally heating up to a temperature of 100° C. or higher and the temperature of the wall surface of the container was recorded by means of thermocouples attached thereto. According to the record of temperature obtained with the thermocouple attached to the wall surface just above the fuse head, the temperature was rapidly increased by ignition up to a maximum temperature of 948° C. The duration of the time for a ±5° C. or ±10° C. temperature range including the maximum temperature, i.e. the duration of time in which the temperature was in the range from 938° C. to 948° C., i.e. from 938° C. up to 948° C. and from 948° C. down to 938° C., and in the range from 928° C. to 948° C., was about 1 second and about 2 seconds, respectively. On the other hand, the temperature at the end of the container remote from the ignitor assembly in contact with the calorific mixture could not exceed 736° C. presumably because the amount of the metallic material forming the container was large in the end portion of the container relative to the effective amount of the calorific mixture.

EXAMPLE 2

An exothermic device was constructed in substantially the same manner as in Example 1 described above excepting increase of the amount of the calorific mixture to 4.98 g. The temperature on the side walls of the container was recorded at two points 20 mm and 40 mm apart in the longitudinal direction of the container from the ignition end of the calorific mixture. The maximum temperatures recorded were 997° C. and 1100° C. at the measuring points near to and remote from the ignition end of the calorific mixture, respectively. This difference of about 100° C. was presumably due to the uneven packing density of the calorific mixture and the conduction of heat through the container walls in the direction of propagation of the combustion reaction in the exothermic mixture. The duration of the time for a ±5° C. or ±10° C. temperature range including the maximum temperature was about 1.5 seconds or about 3 seconds, respectively, at each of the two measuring points.

Figure 2:
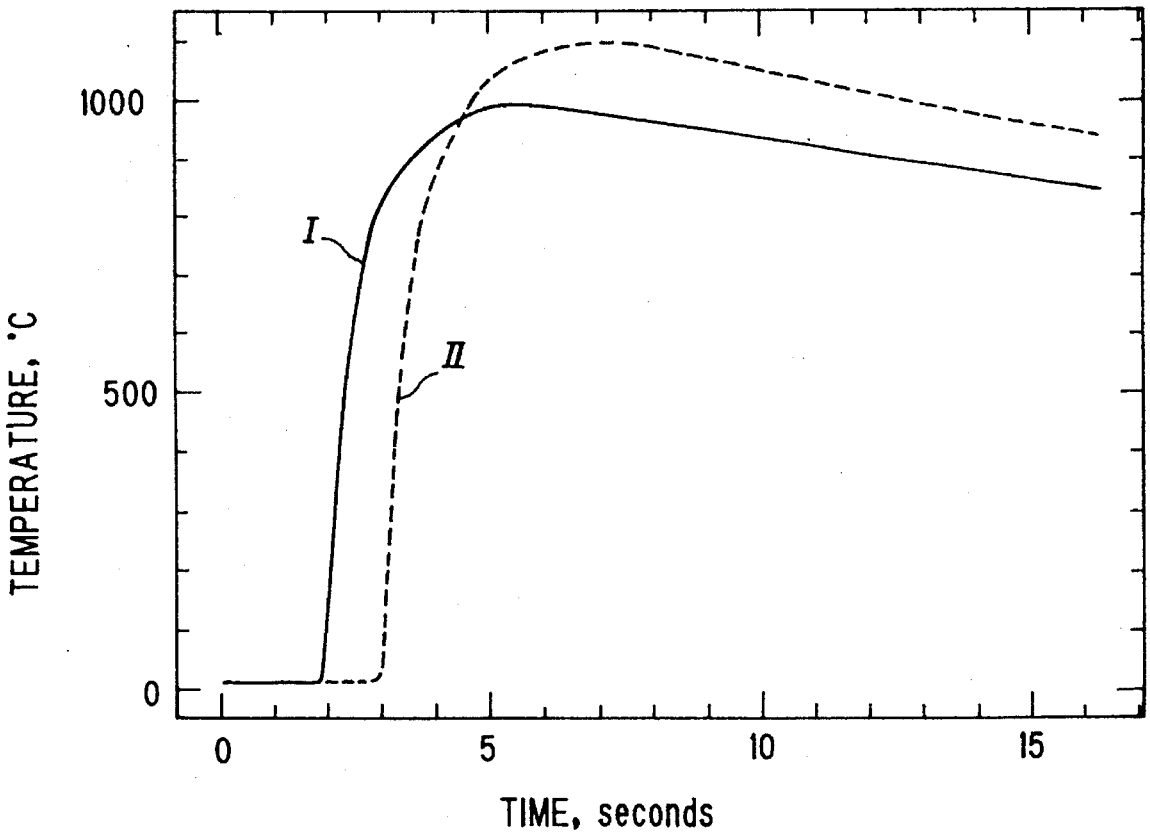
FIG. 2 is a graph showing the temperature of the wall surface of the exothermic device as a function of the time after ignition.

FIG. 2 of the accompanying drawing is a graph showing the temperature of the outer surface recorded with thermocouples in the above described experiment as a function of time in seconds from the moment of ignition of the calorific mixture as determined by using two thermocouples attached to the outer surface of the exothermic device with a distance of 20 mm from each other. Namely, the curve I of FIG. 2 shows the result of the measurement by using the first thermocouple at a point near to the ignition end of the calorific mixture and the curve II shows the result of the measurement by using the second thermocouple at a point remote from the ignition end. As is understood from these curves, rapid increase in the temperature of the outer surface of the container was started at a moment when the propagating combustion zone of the calorific mixture reached just beneath the spot of the surface to reach a maximum temperature followed by gradual decrease of the temperature. It is noted in FIG. 2 that the maximum temperature measured by the second thermocouple is somewhat higher than the maximum temperature measured with the first thermocouple. Although the possible non-uniformity in the packing density of the calorific mixture within the container may well explain this difference in the maximum temperatures between two points 20 mm apart, another possibility to explain this phenomenon would be conduction of heat evolved in the calorific mixture through the walls of the container in the longitudinal direction or, namely, in the direction of propagation of the combustive reaction in the calorific mixture.

EXAMPLE 3

The experimental procedure was substantially the same as in Example 1 except that the container of the exothermic device having the same dimensions as that used in Example 1 was made from copper instead of stainless steel and temperature measurement of the container walls was conducted at two points of just the same distances from the ignition end as in Example 2. The maximum temperature attainable on the container walls estimated by calculation was 969° C. with the heat capacity of the copper container taken into account. The actually recorded maximum temperatures were 945° C. and 1042° C. The duration of the time for a ±5° C. or ±10° C. temperature range including the maximum temperature was about 2 seconds or about 3 seconds, respectively, at each of the two measuring points.

EXAMPLE 4

The experimental procedure was substantially the same as in Example 3 except that the calorific mixture was prepared from the titanium powder and the boron powder in a molar ratio of 1:2 and contained 55% by weight of a metallic copper powder having fineness to pass through a 200 mesh screen and the amount of the calorific mixture introduced into the copper container was 4.63 g. The maximum temperature attainable with this calorific mixture estimated by calculation was 2474° C. while the maximum temperature attainable on the container walls estimated by calculation was 736° C. with the heat capacity of the copper container taken into account. The actually recorded maximum temperatures were 755° C. and 948° C. The duration of the time for a ±5° C. or ±10° C. temperature range including the maximum temperature was about 3 seconds and about 5 seconds, respectively.

EXAMPLE 5

A cylindrical container having an outer diameter of 20 mm, inner diameter of 18 mm and length of 60 mm was prepared from graphite and an exothermic device was prepared by introducing 24 g of a calorific mixture consisting of a metallic zirconium powder having fineness to pass through a 325 mesh screen and a boron powder having an average particle diameter of about 0.5 μm in a molar ratio of 1:2 into the graphite container together with a fuse head contacting with the calorific mixture. The ignition element was connected to an externally installed dry battery with lead wires through a switch. The exothermic device was placed in a vacuum chamber and the fuse head was ignited by-momentarily closing the electric circuit. The maximum temperature obtained on the surface of the graphite walls of the exothermic device was 2014° C.

EXAMPLE 6

A cylindrical container having an outer diameter of 10 mm, inner diameter of 8 mm and length of 60 mm was prepared from porous silicon carbide and an exothermic device was prepared by introducing 9 g of a calorific mixture consisting of a metallic zirconium powder and a carbon powder each having fineness to pass through a 325 mesh screen in a molar ratio of 1:1 and containing 10% by weight of a zirconium carbide powder into the silicon carbide container together with a fuse head contacting with the 8calorific mixture. The fuse head was ignited in the same manner as in Example 5. The maximum temperature obtained on the surface of the silicon carbide walls of the exothermic device was 2044° C.

EXAMPLE 7

A cylindrical container having an outer diameter of 10 mm, inner diameter of 9.6 mm and length of 90 mm was prepared from metallic tantalum and an exothermic device was prepared in the same manner as in Example 1 by introducing 8 g of a calorific mixture consisting of a metallic titanium powder having fineness to pass through a 350 mesh screen and a boron powder having an average particle diameter of about 0.5 μm in a molar ratio of 1:2 and containing 20% by weight of a titanium boride powder into the tantalum container together with a fuse head contacting with the calorific mixture, switching device and silver oxide battery. The maximum temperature obtained on the surface of the tantalum walls of the exothermic device was 2647° C.

EXAMPLE 8

A container having the same dimensions as in Example 7 was prepared from metallic tantalum and an exothermic device was prepared in the same manner as in Example 1 excepting replacement of the calorific mixture of titanium, boron and aluminum oxide with 22 g of another calorific mixture consisting of a metallic niobium powder of 325 mesh fineness, boron powder of 0.5 μm particle diameter and carbon powder of 325 mesh fineness in a molar ratio of 2:2:1. The maximum temperature obtained on the surface of the tantalum walls of the exothermic device was 1690° C.

EXAMPLE 9

A cylindrical container having an outer diameter of 10 mm, inner diameter of 9.6 mm and length of 90 mm was prepared from metallic tungsten and an exothermic device was prepared in the same manner as in Example 1 by introducing 42 g of a calorific mixture consisting of a metallic hafnium powder and a carbon powder each having fineness to pass through a 325 mesh screen in a molar ratio of 1:1 and containing 28% by weight of a hafnium carbide powder into the tungsten container together with a fuse head contacting with the calorific mixture, switching device and silver oxide battery. The maximum temperature obtained on the surface of the tungsten walls of the exothermic device was 3004° C.

What is claimed is:

1. A high-temperature exothermic device which is a hermetically sealed integral device comprising:

(a) a hermetically sealable container made from a metallic or ceramic material;

(b) a calorific mixture consisting of a powder of a reactive metal selected from the group consisting of titanium, zirconium, niobium and hafnium and a powder of boron or carbon to fill at least a part of the container; and (c) an ignition means in contact with the calorific mixture contained in the container to ignite the calorific mixture.

2. The high-temperature exothermic device as claimed in claim 1 in which the metallic material forming the container is selected from the group consisting of copper, iron, nickel, stainless steel, tungsten, tantalum and molybdenum.

3. The high-temperature exothermic device as claimed in claim 1 in which the ceramic material forming the container is selected from the group consisting of silicon carbide, silicon nitride and graphite.

4. The high-temperature exothermic device as claimed in claim 1 in which the powder of the reactive metal has an average particle diameter in the range from 0.1 μm to 100 μm.

5. The high-temperature exothermic device as claimed in claim 1 in which the powder of carbon or boron has an average particle diameter in the range from 0.1 μm to 100 μm.

6. The high-temperature exothermic device as claimed in claim 1 in which the mixing ratio of the powder of a reactive metal and the powder of carbon or boron in the calorific mixture is in the range from 1:1 to 1:3 by moles.

7. The high-temperature exothermic device as claimed in claim 1 in which the calorific mixture further contains a powder of a temperature modulator.

8. The high-temperature exothermic device as claimed in claim 7 in which the temperature modulator is selected from the group consisting of copper, nickel, aluminum, iron, aluminum oxide, zirconium dioxide, niobium oxide, silicon dioxide, magnesium oxide, silicon carbide, titanium carbide, niobium carbide, titanium boride, zirconium boride and niobium boride.

9. The high-temperature exothermic device as claimed in claim 7 in which the amount of the temperature modulator is in the range from 5 to 80% by weight based on the total amount of the mixture consisting of the powder of the reactive metal, the powder of boron or carbon and the temperature modulator.

10. The high-temperature exothermic device as claimed in claim 1 in which the ignition means comprises a battery, a switching means and a fuse head to form an electric circuit and is hermetically sealed in the container.

11. The high-temperature exothermic device as claimed in claim 10 in which the switching means comprises a coil spring consolidated with a metal or alloy having a low melting point in a constricted state in such a fashion that, when the metal or alloy having a low melting point is melted down, the coil spring is released from the constricted state to bring a contact point held thereon into contact with a counterpart contact point to close the electric circuit of the ignition means.

12. The high-temperature exothermic device as claimed in claim 11 in which the metal or alloy having a low melting point is a solder alloy.

* * * * *